US007321274B2

(12) United States Patent
Suzuki

(10) Patent No.: US 7,321,274 B2
(45) Date of Patent: Jan. 22, 2008

(54) RF SWITCH

(75) Inventor: Kenichiro Suzuki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/011,914

(22) Filed: Dec. 14, 2004

(65) Prior Publication Data

US 2005/0128026 A1 Jun. 16, 2005

(30) Foreign Application Priority Data

Dec. 15, 2003 (JP) ..... 2003-416693

(51) Int. Cl.
*H01P 1/10* (2006.01)
*H01P 5/12* (2006.01)

(52) U.S. Cl. ..... 333/104; 333/101

(58) Field of Classification Search ..... 333/101, 333/104, 105, 108

See application file for complete search history.

(56) References Cited

U.S. PATENT DOCUMENTS

| | | | | |
|---|---|---|---|---|
| 5,761,115 | A | 6/1998 | Kozicki et al. | 365/182 |
| 6,542,051 | B1 * | 4/2003 | Nakada | 333/164 |
| 6,744,334 | B1 * | 6/2004 | Marumoto | 333/156 |
| 6,812,810 | B2 * | 11/2004 | Ma et al. | 333/126 |

FOREIGN PATENT DOCUMENTS

| | | |
|---|---|---|
| JP | 11-274805 | 10/1999 |
| JP | 11-340704 | 12/1999 |
| JP | 2001-127501 | 5/2001 |
| JP | 2001-292001 | 10/2001 |
| JP | 2002-252553 | 9/2002 |
| JP | 2002-344395 | 11/2002 |
| JP | 2003-101393 | 4/2003 |

* cited by examiner

*Primary Examiner*—Dean Takaoka
(74) *Attorney, Agent, or Firm*—Scully, Scott, Murphy & Presser, P.C.

(57) ABSTRACT

A RF switch can be used in a wide frequency range and can be manufactured at a low cost. The RF switch changes a signal passing through a waveguide with a variable device that is switchable between the first state in which the variable device has a high resistance and the second state in which the variable device has a low resistance, depending on the direction in which current flows through the variable device. The RF switch includes a high-frequency transmission circuit including the waveguide and at least one variable device, a driver circuit including at least one variable device, and a signal circuit for changing current supplied to the variable devices of the high-frequency transmission circuit and the driver circuit for switching between the first and second states of the variable devices. The variable devices are disposed such that the variable device of the high-frequency transmission circuit and the variable device of the driver circuit are in different states as viewed from the junction between the drive circuit and the high-frequency transmission circuit.

5 Claims, 7 Drawing Sheets

RF SWITCH

BACKGROUND OF THE INVENTION

1. Field of the Invention

The present invention relates to a RF switch, and more particularly to a minute RF switch which can be used in a high frequency range from several MHz to several hundreds GHz.

2. Description of the Related Art

With the rapid progress of mobile telecommunication technology in recent years, the data rate that can be handled by mobile terminals has significantly been increased. Furthermore, to meet market demands for the higher telecommunication data rate, higher frequencies of signal career are being used so that mobile terminals can have wide bandwidth. At present, although mobile terminals use career frequencies ranging from several hundreds MHz to 2 GHz, they are expected, in the near future, to widely use higher career frequencies in the range of several GHz. In the field of wireless communications, high frequencies in a Ka bands from 20 to 30 GHz and a millimeter wave of about 60 GHz for vehicle communications have already been widely used.

FETs fabricated on a GaAs substrate are widely known as switches for handling such high-frequency signals. However, the FETs have a problem that they are expensive since they have to use GaAs substrate. Then, they cannot be constructed as large-scale components because they are expensive, making it difficult to integrate FETs with other devices. Another problem is that the higher frequencies of several GHz or higher tend to produce an increased energy loss, which fails to satisfy requirements for mobile terminals with low power consumption.

There are another known switches based on micro-electro-mechanical systems (MEMS). Since such switches can fabricate on any substrates, they can easily be integrated with other components. Furthermore, because they cause an extremely low energy loss, they are highly expected to be used in high-frequency applications. However, MEMS switches have a disadvantage that they are large in dimension, e.g., approximately size of 100 μm square, and need a high voltage of about 20 V to operate As described above, the existing RF switches have disadvantages of their own. There has been a need for a new RF switch different from those existing devices. Generally, a switch is used to pass or block a signal flowing in a circuit by bringing about a large change in resistance or capacitance. OUM (Ovonic Unified Memory) developed by Intel utilizing the calcogenide semiconductor and PMC (Programmable Metallization Cell) invented by Axon are known as devices for causing large resistance changes.

The PMC disclosed in U.S. Pat. No. 5,761,115 will be described below. In U.S. Pat. No. 5,761,115, a device based on a phenomenon in which a metal dendrite is grown or retracted by a voltage applied thereto is referred to as a PMC, and the idea of using a PMC as a nonvolatile memory is described. Though it is not proposed to use a PMC as a RF switch in the description of U.S. Pat. No. 5,761,115, a PMC is interesting as a RF switch.

FIG. 1(*a*) of the accompanying drawings is a plan view of a PMC according to an embodiment disclosed in U.S. Pat. No. 5,761,115 and FIG. 1(*b*) of the accompanying drawings is a cross-sectional view taken along line A-A' of FIG. 1(*a*). Lower electrode 93 is disposed over substrate 91 with insulating layer 98 interposed therebetween. Lower electrode 93 is patterned in a horizontal direction in FIG. 1(*a*). Second insulating layer 96 is disposed on lower electrode 93 and areas of insulating layer 98 where lower electrode 93 is not provided. Second insulating layer 96 has a via hole 99 defined therein which extends down to the surface of lower electrode 93. Fast ion conductor layer 92 is deposited on the inner side wall of via hole 99. Thereafter, the unfilled portion of via hole 99 is filled up with via filling layer 97. Upper electrode 94 is disposed on via hole 99. Upper electrode 94 is patterned in a vertical direction in FIG. 1(*a*).

When a voltage is applied between lower electrode 93 and upper electrode 94 with a negative voltage level on lower electrode 93, metal dendrite 95 grows from lower electrode 93 toward upper electrode 94 and finally reaches upper electrode 94. At this time, the electric resistance between upper electrode 94 and lower electrode 93 decreases. When the voltage polarity is reversed to apply a voltage between lower electrode 93 and upper electrode 94 with a positive voltage level on lower electrode 93, metal dendrite 95 is retracted from upper electrode 94 toward lower electrode 93. At this time, the electric resistance between upper electrode 94 and lower electrode 93 increases. U.S. Pat. No. 5,761,115 reveals an example in which the fast ion conductor layer is made of $As_2S_3$—Ag or a silver sulfide such as $AgAsS_2$, the upper electrode (anode electrode) of silver or silver-aluminum alloy, and the lower electrode (cathode electrode) of aluminum. Interestingly, when the materials are combined as described above, the metal dendrite grows only when the voltage is applied between the lower electrode and the upper electrode with a negative voltage level on the lower electrode.

It has been found that some problems arise if the PMC disclosed in U.S. Pat. No. 5,761,115 is used as a RF switch.

The first problem is that the device is of a structure wherein two electric interconnects are connected to a switch, and a driver circuit for driving the switch is not isolate from a line for passing a data signal. To drive the switch, therefore, a signal has to be mixed with a data signal, posing a significant limitation on the design of the circuit.

The second problem occurs if the driver circuit is connected parallel to the line for passing the data signal in order to solve the first problem. In a high-frequency waveguide circuit, great care must be taken about an impedance change in the path along which the signal passes. The signal passing through the switch may leak to the driver circuit, thus allowing the switch to cause an increased loss. Depending on the impedance change, the signal may be reflected in the input port, and may not be transmitted in the output port.

The third problem develops if the driver circuit is connected to the signal line through an isolation circuit such as a transistor or the like in order to solve the second problem. In a low frequency range, it is possible to reduce the attenuation of the signal because the driver circuit is isolated from the signal line. At higher frequencies, however, a loss of the signal increases because the isolation characteristic of the transistor is degraded. The signal loss manifests itself at frequencies of several GHz or higher.

The fourth problem is that the whole switch is complex due to the need for a complex driver circuit. With the above intervening transistor, it is necessary to position the transistor as closely to the signal line as possible for the purpose of reducing reflections from the branch at the junction. However, sophisticated packaging technology is required to position the transistor as closely to the signal line as possible. An additional problem is that since the isolation device such as a transistor or the like is incorporated in the switch, the switch as a whole has increased dimensions, and the cost of the switch is high because an additional GaAs substrate is required to integrate the driver circuit.

As described above, even if conventional RF switches are improved using existing techniques, some problems remain unsolved.

SUMMARY OF THE INVENTION

It is an object of the present invention to provide a RF switch which solves the conventional problems, has a low-loss high isolation characteristic, is small in size, can be used in a wide frequency range, and can be fabricated at a low cost.

According to the present invention, there is provided a RF switch for changing a signal passing through a waveguide with a variable device switchable between the first state in which the variable device has a high resistance-and the second state in which the variable device has a low resistance, depending on the direction in which a current flows through the variable device, the RF switch comprising a high-frequency transmission circuit including the waveguide and at least one variable device, a driver circuit including at least one variable device, and a signal circuit for changing a current supplied to the variable devices of the high-frequency transmission circuit and the driver circuit to switch between the first and second states of the variable devices, the drive circuit and the high-frequency transmission circuit being electrically connected to each other at a junction, the variable devices being disposed such that the variable device of the high-frequency transmission circuit and the variable device of the driver circuit are in different states as viewed from the junction.

The driver circuit may include a resistor having a substantially constant resistance, and the signal circuit may be connected to one end of the variable device of the high-frequency transmission circuit through the variable device of the driver circuit, and connected to another end of the variable, device of the high-frequency transmission circuit through the resistor.

The substantially constant resistance of the resistor may have a value of at least 10 kΩ.

The driver circuit may include first and second variable devices, and the signal circuit may be connected to one end of the variable device of the high-frequency transmission circuit through the first variable device of the driver circuit, and connected to another end of the variable device of the high-frequency transmission circuit through the second variable device of the driver circuit.

The RF switch may further include a bias circuit connected to one end of the variable device of the high-frequency transmission circuit, and the signal circuit may be connected to one end of the variable device of the high-frequency transmission circuit through the variable device of the driver circuit, and also connected to a bias voltage source.

The resistance of each of the variable devices may be variable in a range from 1 Ω to 1 kΩ.

High-frequency waveguide circuits are usually designed to have an impedance of 50 Ω. When the resistance of a resistor inserted in series in such a high-frequency waveguide circuit is changed, a signal passing through the high-frequency waveguide circuit is attenuated to a different degree depending on the resistance of the resistor. For example, when the resistance of the resistor is 1 Ω or less, the signal is attenuated by 1%, and when the resistance of the resistor is 10 kΩ, the signal is attenuated by 99%. This is the principle of a RF switch having a variable resistor connected in series in a high-frequency waveguide circuit.

If a circuit connected as a branch to a high-frequency waveguide circuit at a junction has a resistance of 10 kΩ near the junction, then the attenuation of a signal passing through the high-frequency waveguide circuit can be reduced to 1% or less. That is, any adverse effect that the branch has on the signal can be essentially ignored.

As described above with respect to the related art, some devices have a resistance highly variable depending on the direction in which a voltage is applied thereto or the direction in which current flows therethrough. According to the present invention, at least two of such variable-resistance devices are combined, with one connected in series to a waveguide, thereby providing a high-frequency signal for switching a data signal. The other variable-resistance device is connected between the waveguide and a driver circuit for branching and actuating the waveguide. The latter variable-resistance device serves to transmit a control signal from the driver circuit to the waveguide, and also to prevent the data signal from leaking from the waveguide.

While variable-resistance devices have been described above, the present invention is not limited to variable-resistance devices, but may be applied to devices having a variable electric capacitance or inductance. The RF switch is not limited to an arrangement in which a resistor is connected in series to a waveguide, but is also applicable to an arrangement in which a resistor is connected in parallel to a waveguide.

According to the present invention, there is provided a RF switch having a waveguide and a driver circuit isolated therefrom. Since the driver circuit is isolated from the waveguide, the RF switch can easily be incorporated into circuits. The RF switch has a low-loss high isolation characteristic, is small in size, can be used in a wide frequency range, and can be fabricated at a low cost.

The above and other objects, features, and advantages of the present invention will become apparent from the following description with reference to the accompanying drawings which illustrate examples of the present invention.

DETAILED DESCRIPTION OF THE PREFERRED EMBODIMENTS

RF switches according to preferred embodiments of the present invention will be described in detail below with reference to the drawings.

Figure 1A:
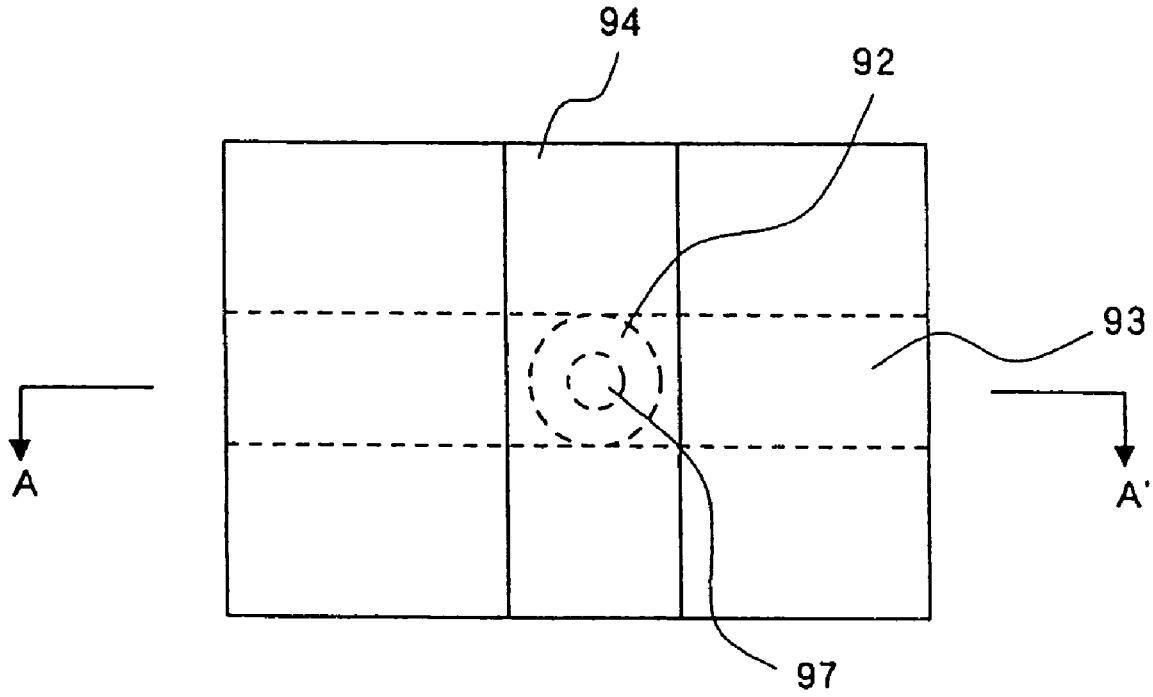
Fig.1(a) PRIOR ART
FIGS. 1(*a*) and 1(*b*) are plan and cross-sectional views, respectively, of a conventional switch.
Figure 1B:
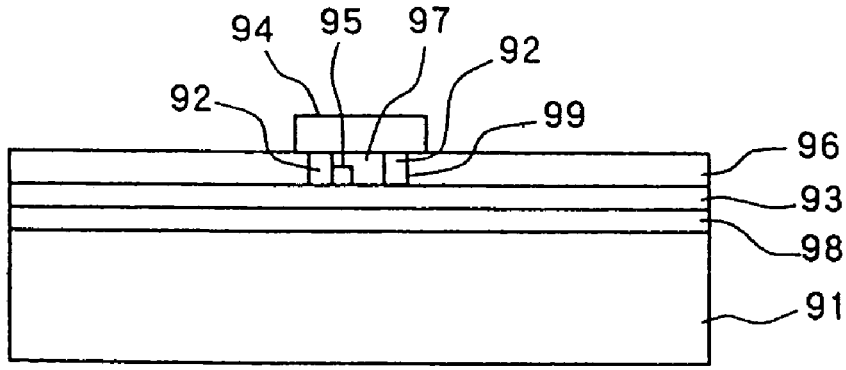
Fig.1(b) PRIOR ART
Figure 2:
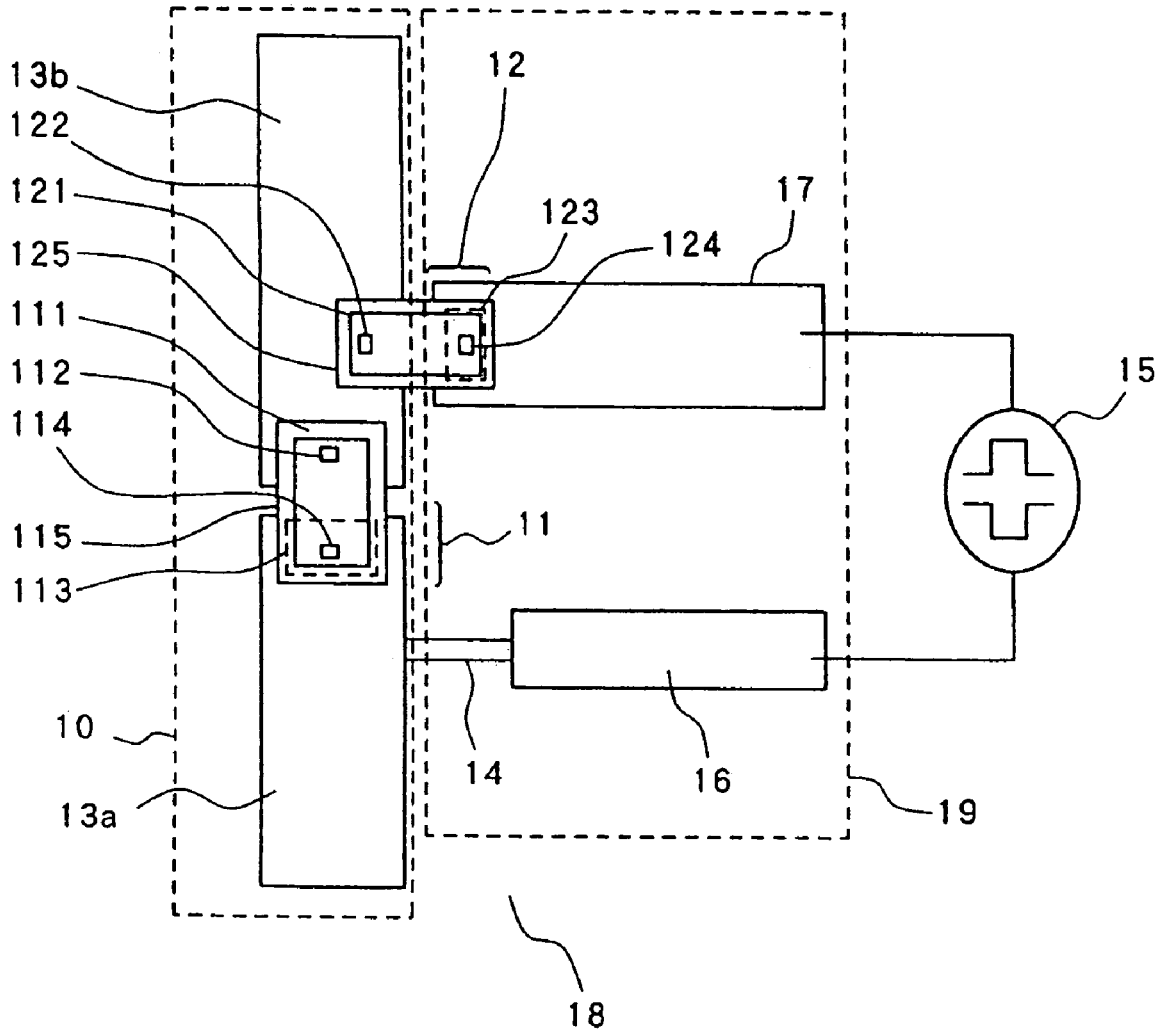
FIG. 2 is a plan view of a RF switch according to the first embodiment of the present invention.

FIG. 2 shows a plan of a RF switch according to the first embodiment of the present invention. The RF switch according to the first embodiment comprises high-frequency transmission circuit 10 for passing a high-frequency signal therethrough and driver circuit 19 for controlling the transmission of the signal. High-frequency transmission circuit 10 comprises high-frequency waveguides 13*a*, 13*b* and first variable-resistance device 11 having a resistance variable depending on the direction of the voltage or current.

High-frequency waveguides 13*a*, 13*b* are constructed as microstrip waveguide circuits, coplanar waveguide circuits, or the like, and are suitable for the transmission of high-frequency signals without any loss. For example, high-frequency waveguides 13*a*, 13*b*, each comprising a gold interconnect layer having a thickness of 2 μm and a width of 40 μm, are mounted on insulating substrate 18 made of glass or the like, and a thin metal film on the reverse side of substrate 18 is kept as a ground potential.

High-frequency waveguide 13*a* is connected to an output port of an external waveguide circuit (not shown) by a gold wire or the like, and high-frequency waveguide 13*b* is connected to an input port of the external waveguide circuit by a gold wire or the like. High-frequency waveguides 13*a*, 13*b* are connected to each other by first variable-resistance device 11. First variable-resistance device 11 comprises variable-resistance layer 113, insulating film 115 in the form of a silicon nitride film or the like, and upper electrode 111 which are successively deposited.

Variable-resistance layer 113 is formed by successively depositing a layer of copper having a thickness of 200 nm and a layer of copper sulfide having a thickness of 20 nm on high-frequency waveguide 13*a*.

Upper electrode 111 comprises a layer of metal such as gold or the like having a thickness of 2 μm and a width of 30 microns, and is connected to variable-resistance layer 113 through contact hole 114 that is defined in insulating film 115. Upper electrode 111 is also connected to high-frequency waveguide 13*b* through contact hole 112 that is defined in insulating film 115.

First variable-resistance device 11 has a low resistance when a voltage is applied thereto that causes a current to flow in a direction from high-frequency waveguide 13*a* to high-frequency waveguide 13*b*, and has a high resistance of 10 k Ω or higher when a voltage is applied thereto to cause a current to flow in the reverse direction. A device which was actually fabricated as first variable-resistance device 11 was measured for its resistance. When a voltage of 0.2 V was applied to the device to cause a current to flow in a direction from high-frequency waveguide 13*a* to high-frequency waveguide 13*b*, the device had a resistance of 2 Ω or less (at this time, a current of about 100 mA flowed through the device). When a voltage of 0.06 V was applied to the device to cause a current to flow in the reverse direction-, the device had a resistance of 100 kΩ (at this time, a current of about 1 μA or less flowed through the device).

Driver circuit 19 comprises second variable-resistance device 12 and fixed resistor 14 having a resistance of about 10 k Ω and is connected to external signal circuit 15. Second variable-resistance device 12 comprises variable-resistance layer 123, insulating film 125 in the form of a silicon nitride film or the like, and upper electrode 121 which are successively deposited in the order named.

Variable-resistance layer 123 is formed by successively depositing a layer of copper having a thickness of 200 nm and a layer of copper sulfide having a thickness of 20 nm on metal interconnect 17.

Upper electrode 121 comprises a layer of metal such as gold or the like having a thickness of 0.2 μm and a width of 30 microns, and is connected to variable-resistance layer 123 through contact hole 124 that is defined in insulating film 125. Upper electrode 121 is also connected to high-frequency waveguide 13*b* through contact hole 122 that is defined in insulating film 125.

Second variable-resistance device 12 has a low resistance of 2 Ω or less when a voltage is applied thereto that causes current to flow in a direction from metal interconnect 17 to high-frequency waveguide 13*b*, and has a high resistance of 10 kΩ or higher when a voltage is applied thereto that causes current to flow in the reverse direction.

Fixed resistor 14 has an actual constant resistance regardless of the direction of the current flowing therethrough and the magnitude of a voltage applied thereto, and is connected between high-frequency waveguide 13*a* and metal interconnect 16. Fixed resistor 14 is made of high-resistance metal such as tantalum nitride or the like, and has a width of 5 μm, a length of 3 mm, and a thickness of 0.1 μm. Fixed resistor 14 may occupy a reduced area if it is folded into multiple layers. Each of two metal interconnects 16, 17 is made of metal such as aluminum, gold, or the like, and has a width of 20 μm and a thickness of 0.2 μm.

Signal circuit 15 is connected to two metal interconnects 16, 17 for producing a signal to operate the RF switch, i.e., a signal to control a voltage applied to driver circuit 19 or a current flowing through driver circuit 19. In the present embodiment, the directions from variable-resistance devices 11, 12 to high-frequency waveguide 13*b* are referred to as forward directions in which the resistance of variable-resistance devices 11, 12 is lower when current flows therethrough in those directions.

Operation of the RF switch according to the present embodiment will be described below with reference to FIGS. 3(*a*) and 3(*b*). Those parts in FIGS. 3(*a*) and 3(*b*) which are identical to those shown in FIG. 2 are denoted by identical reference characters.

Figure 3B:
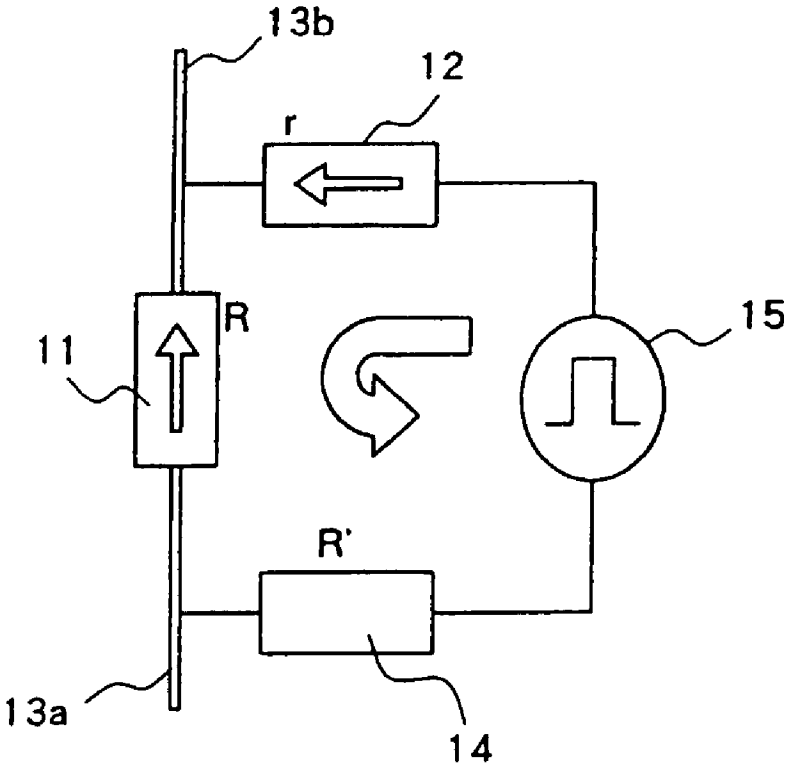
FIGS. 3(*a*) and 3(*b*) are schematic views showing the manner in which the RF switch according to the first embodiment of the present invention operates.
Figure 3A:
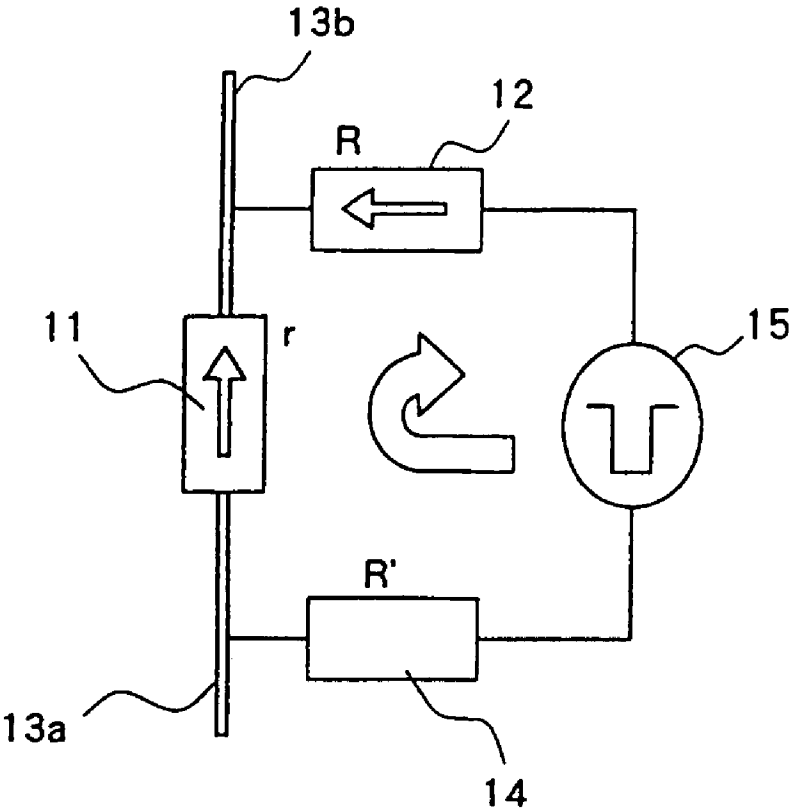
Figure 4A:
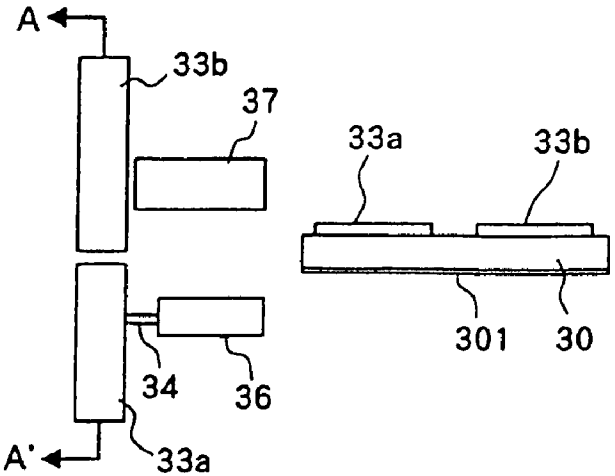
FIGS. 4(*a*) through 4(*d*) are plan and cross-sectional views illustrative of a process of fabricating the RF switch according to the first embodiment of the present invention.
Figure 4B:
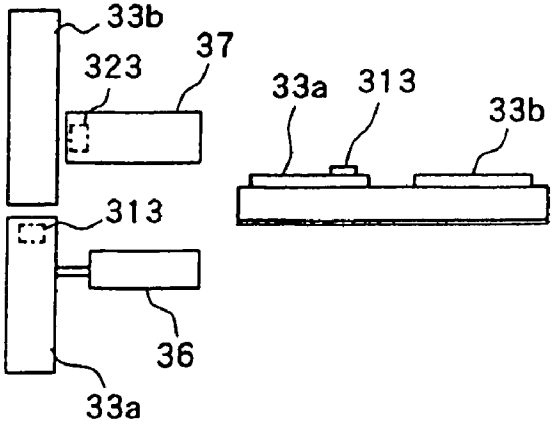
Figure 4C:
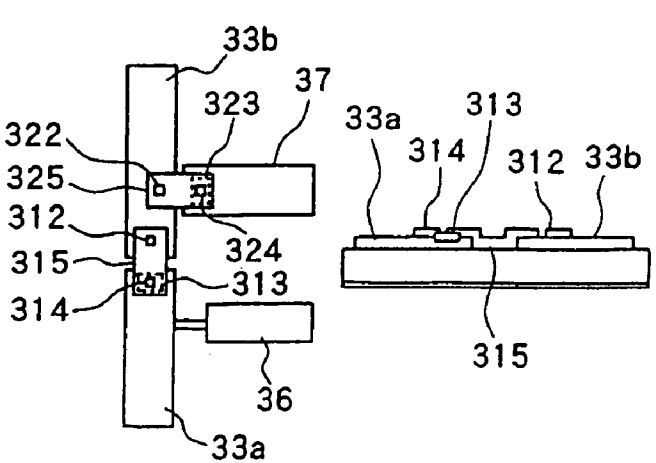
Figure 4D:
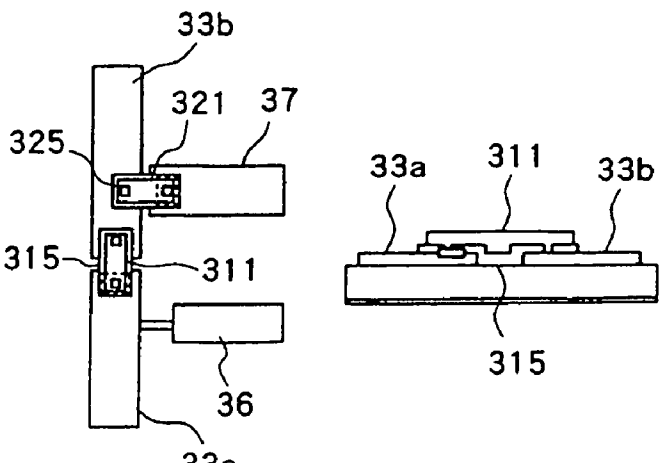

FIG. 3(*a*) shows the manner in which a control signal is applied to signal circuit 15 to cause a current to flow clockwise in driver circuit 19. At this time, since first variable-resistance circuit 11 is biased in the forward direction, first variable-resistance circuit 11 has a low resistance (r). Second variable-resistance circuit 12 has a high resistance (R) of 10 k Ω or higher because second variable-resistance circuit 12 is reverse-biased. A high-frequency signal applied to high-frequency waveguide 13*a* passes through first variable-resistance circuit 11 with a low loss, and is output to high-frequency waveguide 13*b*. As the high-frequency signal does not leak into the branch line connected to second variable-resistance device 12, the high-frequency signal passes through high-frequency waveguide 13*b* with a low loss. This state continues until a control signal is applied in the reverse direction to signal circuit 15, and there is no need to keep applying the forward control signal in the meantime.

FIG. 3(*b*) shows the manner in which a control signal is applied to signal circuit 15 to cause a current to flow counterclockwise in driver circuit 19. A voltage which is expressed by about R/(R+R') of the voltage that was first applied to signal circuit 15 is applied to second variable-resistance circuit 12, where R' represents the resistance of fixed resistor 14. If the resistances R, R' are about 10 kΩ, then a voltage which is about one-half of the voltage that was first applied to signal circuit 15 is applied to second variable-resistance circuit 12. Since the voltage is applied to second variable-resistance circuit 12 in the forward direction, the resistance of second variable-resistance circuit 12 changes to a small value (r). Because the resistance of second variable-resistance circuit 12 changes quickly, a large reverse voltage is applied across first variable-resistance circuit 11, whose resistance changes to a large value (R). At this time, a high-frequency signal applied to high-frequency wave guide 13*a* is reflected by first variable-resistance circuit 11 and hence is not outputted to high-frequency waveguide 13*b*. The high-frequency signal does not leak into the branch line connected to fixed resistor 14. Therefore, the high-frequency signal is unable to travel through high-frequency waveguide 13*b*. This state continues until a control signal is applied in the forward direction to signal circuit 15, and there is no need to keep applying the reverse control signal in the meantime.

A process for manufacturing the RF switch will be described below. FIGS. 4(*a*) through 4(*d*) are views showing successive steps of the process for manufacturing the RF switch. In each of FIGS. 4(*a*) through 4(*d*), the left figure is a plan view, and the right figure is a cross-sectional view taken along line A-A' of the plan view.

First, as shown in FIG. 4(*a*), the reverse side of glass substrate 30 is coated with a thin film of gold, providing ground layer 301. A pattern of fixed resistor 34 is formed of chromium nitride to a thickness of 0.1 μm on the face side of glass substrate 30. Then, the face side of glass substrate 30 is covered with a film of gold having a thickness of 0.3 μm, and a film of gold having a thickness of 1.7 μm is deposited only in those areas of the face side of glass substrate 30 which correspond to waveguides 33*a*, 33*b*. Thereafter, patterns of waveguides 33*a*, 33*b* and metal interconnects 36, 37 are formed as a resist on the surface formed. Using the resist as a mask, the film of gold having a thickness of 0.3 μm is etched away. Finally, the resist is removed.

Then, as shown in FIG. 4(*b*), a thin film of copper having a thickness of 0.2 μm is deposited on glass substrate 30. Thereafter, the surface of the thin film of copper is partly sulfurized into copper sulfide as follows: Substrate 30 is placed in a solution of sodium sulfide, and a power supply is connected to substrate 30 such that the thin film of copper on substrate 30 is positively biased with respect to the solution of sodium sulfide. The power supply is set to cause a current of about 100 μA to flow, thus forming a film of copper sulfide to a thickness of 20 nm. Thereafter, the film of copper sulfide and the film of copper are etched away to form patterns 313, 323 respectively on waveguide 33*a* and metal interconnect 37.

Then, as shown in FIG. 4(*c*), a film of silicon nitride having a thickness of about 0.3 μm is deposited on substrate 30, forming patterns of insulating films 315, 325. At the same time, contact holes 314, 312 are formed in the pattern of insulating film 315 so as to expose the surface of pattern 313 of copper sulfide and the surface of waveguide 33*b* of gold through contact holes 314, 31.2, and contact holes 324, 322 are formed in the pattern of insulating film 325 so as to expose the surface of pattern 323 and the surface of waveguide 33*b* through contact holes 324, 322.

Then, as shown in FIG. 4(*d*), a film of gold having a thickness of 0.3 μm is deposited on substrate 30, and then a film of gold having a thickness of about 1.7 μm is deposited only in the area which corresponds to upper electrode 311 by electric plating. Thereafter, using a resist as a mask, the deposited film of gold is etched away to form patterns of upper electrodes 311, 321. Finally, the resist is removed. Upper electrode 311 is electrically connected to pattern 313 and waveguide 33*b* through contact holes 314, 312 in insulating film 315. Upper electrode 321 is electrically connected to pattern 323 and waveguide 33*b* through contact holes 324, 322 in insulating film 325.

In the embodiment shown in FIG. 2, it is possible to switch around the positions of first variable-resistance device 11 and contact hole 112. According to such a modification, variable-resistance layer 113 is formed by successively depositing a layer of copper sulfide and a layer of copper on high-frequency waveguide 13*b*. First variable-resistance device 11 changes its resistance in the same manner as described above depending on the direction of current flowing therethrough. Similarly, it is possible to switch around the positions of second variable-resistance device 12 and contact hole 122 while allowing second variable-resistance device 12 to change its resistance in the same manner as described above.

Variable-resistance devices 11, 12 do not need to be provided in each of the junctions of a circuit. Variable-resistance devices of the above structure may be provided on both ends of a junction of a circuit while being allowed to change their resistance in the same manner as described above depending on the direction of current flowing therethrough.

Second variable-resistance device 12 of driver circuit 19 may be connected to upper electrode 111 rather than high-frequency waveguide 13*b*. According to this modification, upper electrode 111 and upper electrode 121 may be connected directly with each other without the need for a contact hole.

In the above embodiment, the directions from variable-resistance devices 11, 12 to high-frequency waveguide 13*b* are referred to as forward directions in which the resistances of variable-resistance devices 11, 12 are low when a current flows therethrough in those directions. However, variable-resistance devices 11, 12 may be oriented such that the resistances of variable-resistance devices 11, 12 are high when current flows therethrough in both directions from variable-resistance devices 11, 12 to high-frequency waveguide 13*b*. Such an alternative arrangement offers the same advantages as described above.

Figure 5:
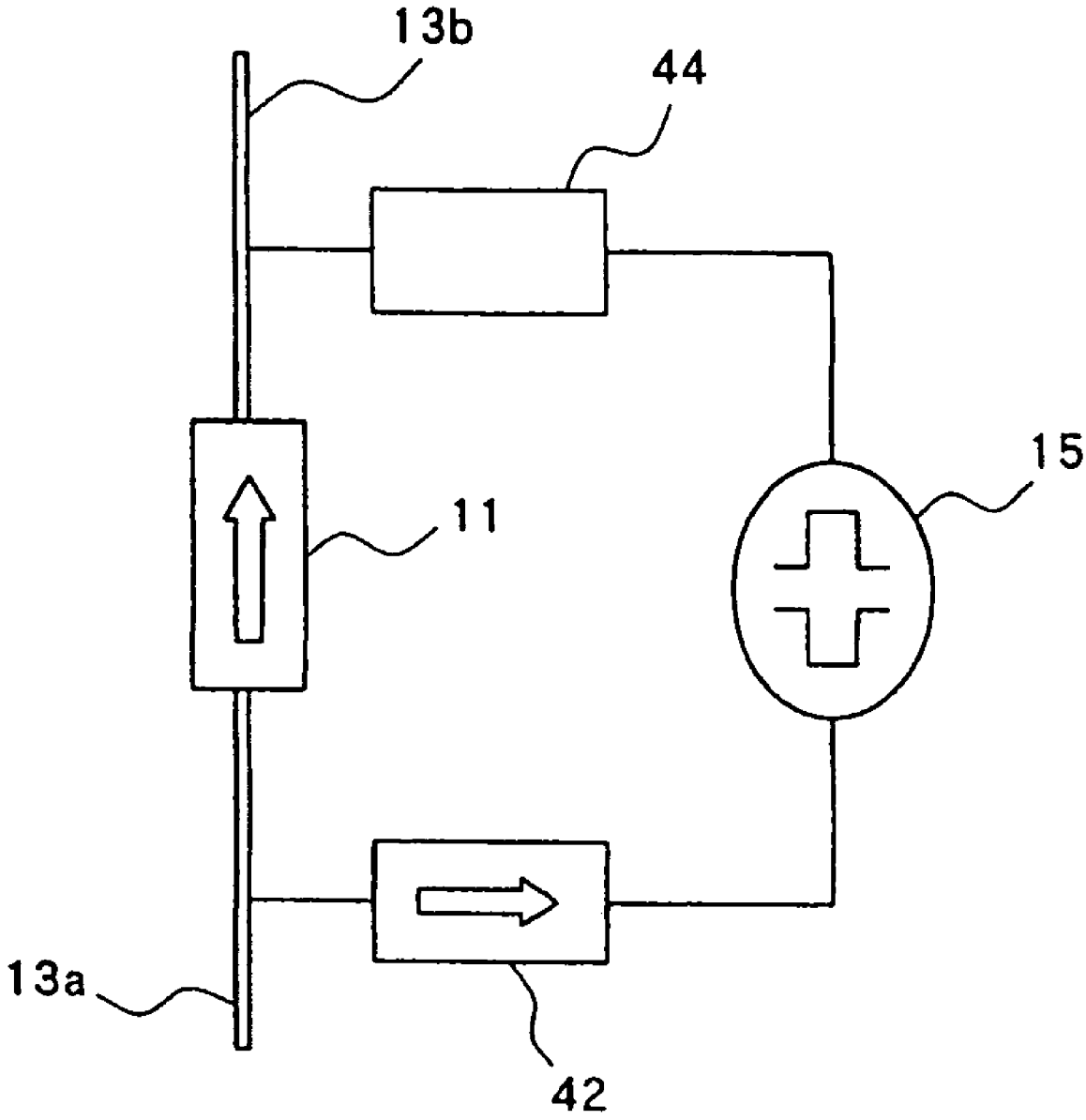
FIG. 5 is a schematic view of a RF switch according to the second embodiment of the present invention.

FIG. 5 is a schematic view showing the equivalent circuit of a RF switch according to the second embodiment of the present invention. Those parts in FIG. 5 which are identical to those shown in FIGS. 3(*a*) and 3(*b*) are denoted by identical reference characters. According to the second embodiment, fixed resistor 44 and second variable-resistance device 42 are disposed in the respective positions of variable-resistance device 12 and fixed resistor 14 of the RF switch according to the first embodiment. The forward direction of second variable-resistance device 42 is opposite to the forward direction of second variable-resistance device 12 according to the first embodiment.

Operation of the RF switch according to the present embodiment will be described below with reference to FIGS. 6(*a*) and 6(*b*). Those parts in FIGS. 6(*a*) and 6(*b*) which are identical to those shown in FIG. 5 are denoted by identical reference characters.

Figure 6B:
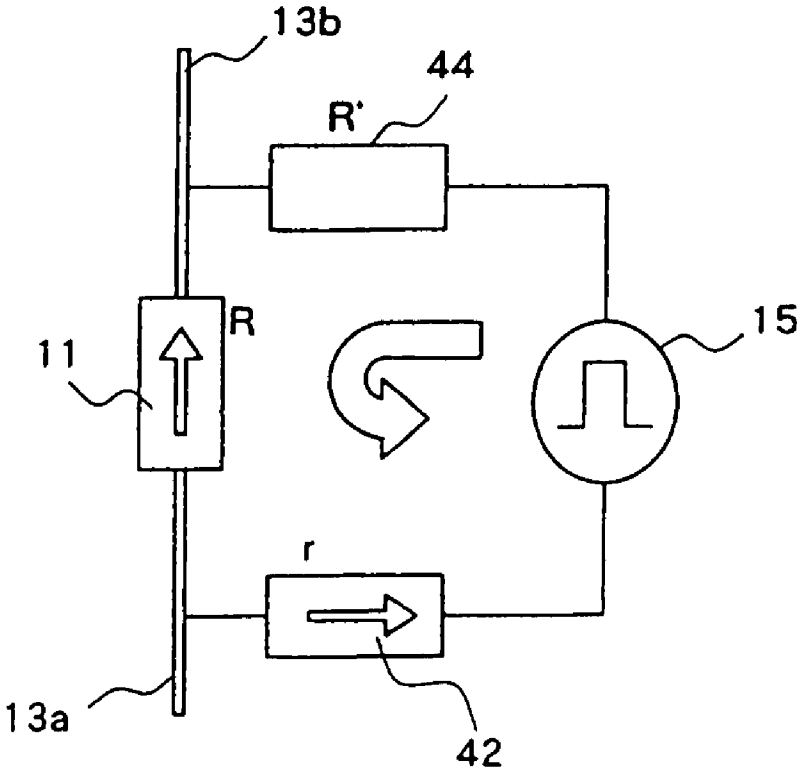
FIGS. 6(*a*) and 6(*b*) are views showing the manner in which the RF switch operates according to the second embodiment of the present invention.
Figure 6A:
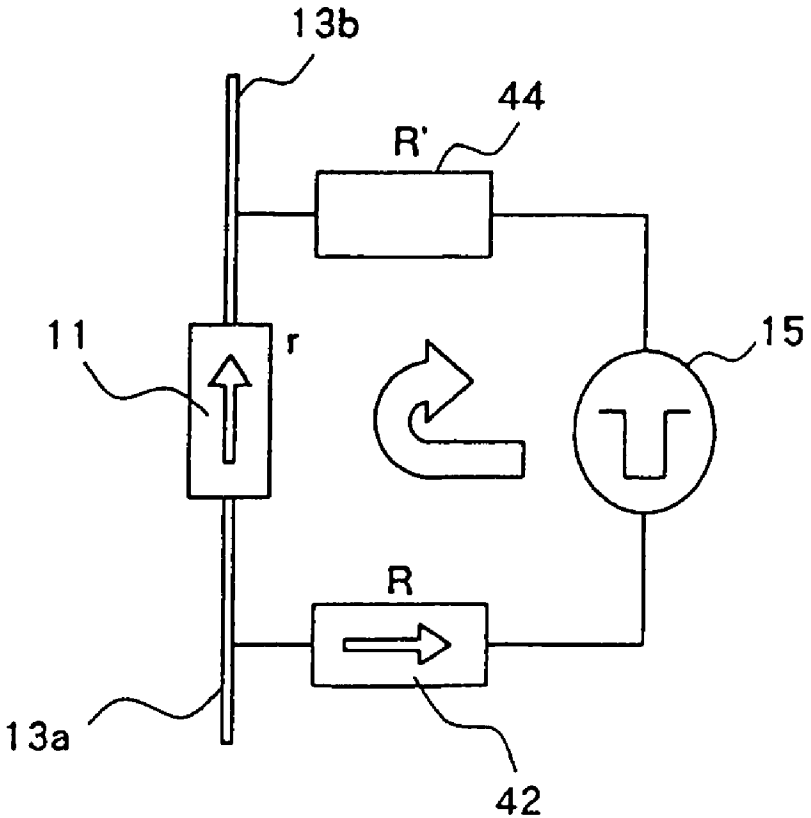

FIG. 6(*a*) shows the manner in which a control signal is applied to signal circuit 15 to cause current to flow clockwise in driver circuit 19. At this time, since first variable-resistance circuit 11 is biased in the forward direction, it has a low resistance (r). Second variable-resistance circuit 42 has a high resistance (R) of 10 kΩ or higher because second variable-resistance circuit 42 is reverse-biased. A high-frequency signal applied to high-frequency waveguide 13*a* passes through first variable-resistance circuit 11 with a low loss, and is outputted to high-frequency waveguide 13*b*. As the high-frequency signal does not leak into the branch lines connected to second variable-resistance device 42 and fixed resistor 44, the high-frequency signal passes through high-frequency waveguide 13*b* with a low loss. This state continues until a control signal is applied in the reverse direction to signal circuit 15, and there is no need to keep applying the forward control signal in the meantime.

FIG. 6(*b*) shows the manner in which a control signal is applied to signal circuit 15 to cause a current to flow counterclockwise in driver circuit 19. A voltage which is expressed by about R/(R+R') of the voltage that was first applied to signal circuit 15 is applied to second variable-resistance circuit 42, where R' represents the resistance of fixed resistor 44. If the resistances R, R' are about 10 kΩ, then a voltage which is about one-half of the voltage that was first applied to signal circuit 15 is applied to second variable-resistance circuit 42. Since the voltage is applied to second variable-resistance circuit 42 in the forward direction, the resistance of second variable-resistance circuit 42 changes to a small value (r). As the resistance of second variable-resistance circuit 42 changes quickly, a large reverse voltage is applied across first variable-resistance circuit 11 whose resistance changes to a large value (R). At this time, a high-frequency signal applied to high frequency waveguide 13*a* is reflected by first variable-resistance circuit 11 and hence is not outputted to high-frequency waveguide 13*b*. The high-frequency signal is unable to enter high-frequency waveguide 13*b* through the branch line connected to fixed resistor 44 because of fixed resistor 44. This state continues until a control signal is applied in the forward direction to signal circuit 15, and there is no need to keep applying the reverse control signal in the meantime.

In the present embodiment, the directions from variable-resistance devices 11, 42 to high-frequency waveguide 13*a* are referred to as reverse directions in which the resistances of variable-resistance devices 11, 12 are large when current flows therethrough in those directions. However, variable-resistance devices 11, 42 may be oriented such that the resistances of variable-resistance devices 11, 42 are low when current flows therethrough in both directions from variable-resistance devices 11, 42 to high-frequency waveguide 13*a*. Such an alternative arrangement offers the same advantages as described above with respect to the previous embodiment.

Figure 7:
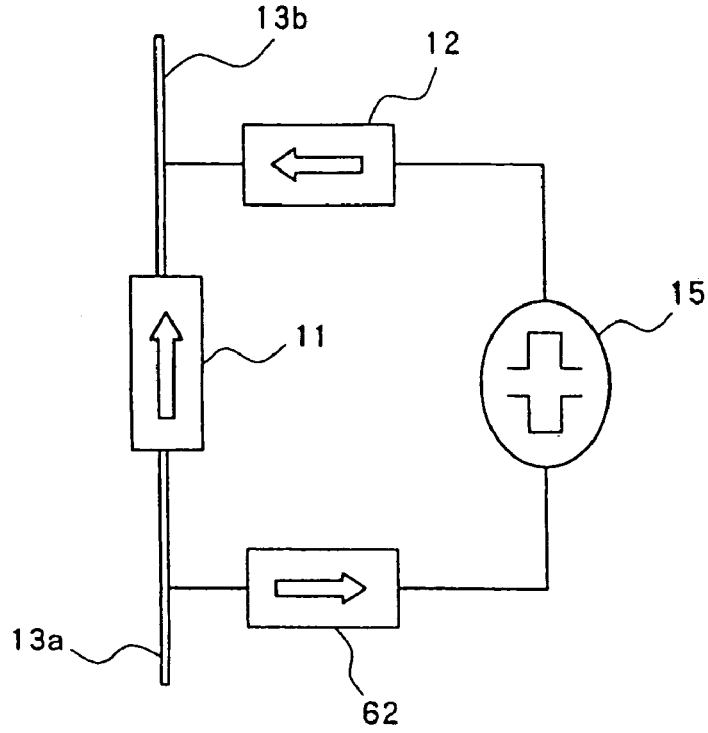
FIG. 7 is a schematic view of a RF switch according to the third embodiment of the present invention.

FIG. 7 is a schematic view showing the equivalent circuit of a RF switch according to the third embodiment of the present invention. Those parts in FIG. 7 which are identical to those shown in FIGS. 3(*a*) and 3(*b*) are denoted by identical reference characters. According to the third embodiment, variable-resistance device 62 is disposed in the position of resistor 14 of the RF switch according to the first embodiment. Therefore the driver circuit has two variable-resistance devices 12, 62. The directions from variable-resistance devices 11, 12 to high-frequency waveguide 13*b* are referred to as forward directions in which the resistances of variable-resistance devices 11, 12 are low when current flows therethrough in those directions. The directions from variable-resistance devices 11, 62 to high-frequency waveguide 13*a* are referred to as reverse directions in which the resistances of variable-resistance devices 11, 62 are high when current flows therethrough in those directions. This arrangement offers the same advantages as described above with respect to the previous embodiments.

Alternatively, variable-resistance devices 11, 12 may be oriented such that the resistances of variable-resistance devices 11, 12 are high when current flows therethrough in the directions from variable-resistance devices 11, 12 to high-frequency waveguide 13*b*, and variable-resistance devices 11, 62 may be oriented such that the resistances of variable-resistance devices 11, 62 are low when current flows therethrough in the directions from variable-resistance devices 11, 62 to high-frequency waveguide 13*a*. Such an alternative arrangement offers the same advantages as described above with respect to the previous embodiments.

Figure 8:
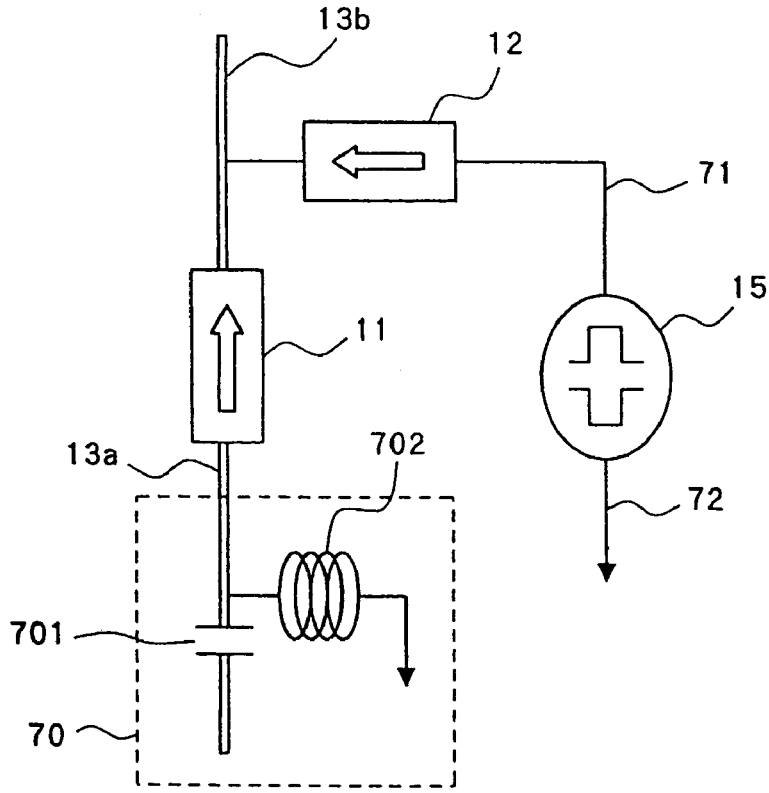
FIG. 8 is a schematic view of a RF switch according to the fourth embodiment of the present invention.

FIG. 8 is a schematic view showing the equivalent circuit of a RF switch according to the fourth embodiment of the present invention. Those parts in FIG. 8 which are identical to those shown in FIGS. 3(*a*) and 3(*b*) are denoted by identical reference characters. According to the fourth embodiment, the RF switch has no fixed resistor and has bias circuit 70 connected to high-frequency waveguide 13*a*. Bias circuit 70 comprises bypass capacitor 701 and bias coil 702 having an end connected to one terminal of bypass capacitor 701. The other end of bias coil 702 is connected to a certain bias voltage source or a ground potential. Bias circuit 70 may be included in the RF switch or may be external and connected to the RF switch. Signal circuit 15 has a terminal connected to second variable-resistance device 12 and another terminal connected to a ground or a bias potential source. In the present embodiment, the directions from variable-resistance devices 11, 12 to high-frequency waveguide 13*b* are referred to as forward directions in which the resistances of variable-resistance devices 11, 12 are low when current flows therethrough in those directions. This arrangement offers the same advantages as described above with respect to the previous embodiments.

Alternatively, variable-resistance devices 11, 12 may be oriented such that the resistances of variable-resistance devices 11, 12 are high when current flows therethrough in the directions from variable-resistance devices 11, 12 to high-frequency waveguide 13*b*.

In the above embodiments, the variable-resistance devices have a variable-resistance layer including a layer of copper sulfide. However, the variable-resistance layer is not limited to copper sulfide, but may be made of a compound of calcogenide (arsenic, germanium, selenium, tellurium, bismuth, nickel, sulfur, polonium, zinc, etc.) and a metal belonging to groups I, II of the periodic table.

While preferred embodiments of the present invention have been described using specific terms, such description is for illustrative purposes only, and it is to be understood that changes and variations may be made without departing from the spirit or scope of the following claims.

What is claimed is:

1. A RF switch for changing a signal passing through a waveguide with a variable device switchable between the first state in which the variable device has a high resistance and the second state in which the variable device has a low resistance, depending on the direction in which current flows through the variable device, said RF switch comprising:

a high-frequency transmission circuit including said waveguide and at least one variable device;

a driver circuit including at least one variable device; and a signal circuit for changing current supplied to the variable devices of said high-frequency transmission circuit, and said driver circuit to switch between the first and second states of said variable devices;

said drive circuit and said high-frequency transmission circuit being electrically connected to each other at a junction, said variable devices being disposed such that the variable device of said high-frequency transmission circuit and the variable device of said driver circuit are in different states as viewed from said junction, wherein the resistance of each of said variable devices is variable in a range from 1 Ω to 1 kΩ.

2. A RF switch according to claim 1 wherein said driver circuit includes a resistor having an actual constant resistance, said signal circuit being connected to an end of the variable device of said high-frequency transmission circuit through the variable device of said driver circuit, and connected to another end of the variable device of said high-frequency transmission circuit through said resistor.

3. A RF switch according to claim 2 wherein said constant resistance of said resistor has a value of at least 10 kΩ.

4. A RF switch according to claim 1 wherein said driver circuit includes the first and the second variable devices, said signal circuit being connected to an end of the variable device of said high-frequency transmission circuit through the first variable device of said driver circuit, and connected to another end of the variable device of said high-frequency transmission circuit through said second variable device of said driver circuit.

5. A RF switch according to claim 1 further comprising:

a bias circuit connected to an end of the variable device of said high-frequency transmission circuit;

said signal circuit being connected to an end of the variable device of said high-frequency transmission circuit through the variable device of said driver circuit, and also connected to a bias voltage source.

* * * * *